US005439283A

United States Patent [19]

Schröder et al.

[11] Patent Number: 5,439,283

[45] Date of Patent: Aug. 8, 1995

[54] ADJUSTMENT DEVICE TO ALIGN A DRAWER

[75] Inventors: Gerhard Schröder, Bad Oeynhausen; Frank Noske, Minden, both of Germany

[73] Assignee: Paul Hettich GmbH & Co., Kirchlengern, Germany

[21] Appl. No.: 180,866

[22] Filed: Jan. 12, 1994

[30] Foreign Application Priority Data

Jan. 12, 1993 [DE] Germany ..... 9300260 U
Mar. 25, 1993 [DE] Germany ..... 9304521 U

[51] Int. Cl.[6] ..... A47B 88/04

[52] U.S. Cl. ..... 312/334.4; 312/334.5; 312/334.38

[58] Field of Search ..... 312/330.1, 334.38, 334.4, 312/334.5, 334.48

[56] References Cited

U.S. PATENT DOCUMENTS

| | | | |
|---|---|---|---|
| 2,551,843 | 5/1951 | Knuth | 312/334.4 |
| 2,594,571 | 4/1952 | Lundberg | 312/334.4 |
| 2,739,864 | 3/1956 | Saunders | 312/334.4 |
| 4,181,376 | 1/1980 | Tah-Sun | 312/334.38 |
| 4,244,546 | 1/1981 | Mertes | 312/334.4 |
| 4,653,821 | 3/1987 | Faust | 312/334.38 |
| 4,810,045 | 3/1989 | Lautenschläger | 312/334.5 |
| 5,310,255 | 5/1994 | Ranallo | 312/334.5 |

FOREIGN PATENT DOCUMENTS

| | | | |
|---|---|---|---|
| 2639686 | 3/1978 | Germany | 312/334.4 |
| 2752779 | 6/1978 | Germany | 312/348 |
| 3505614 | 8/1986 | Germany | 312/334.5 |

*Primary Examiner*—Jose V. Chen
*Assistant Examiner*—Rodney B. White
*Attorney, Agent, or Firm*—Darby & Darby

[57] ABSTRACT

An adjustment device aligns a drawer that is mounted on rails. A body member is fastened to the rail. An activation part is movably hinged to the body member at a hinge area. The activation part is connected to a wedge piece. The activation part is moveable to achieve alignment between the rail and the drawer. The body member, the activation part, and the wedge piece are integrally made of a plastic material. The hinge is formed by a material constriction in the form of a film hinge. The film hinge has an axis that is approximately parallel to a fastening plane disposed between the body member and the rail. The wedge piece extends approximately at right angles to the hinge axis and to the activation part.

13 Claims, 5 Drawing Sheets

FIG. 1
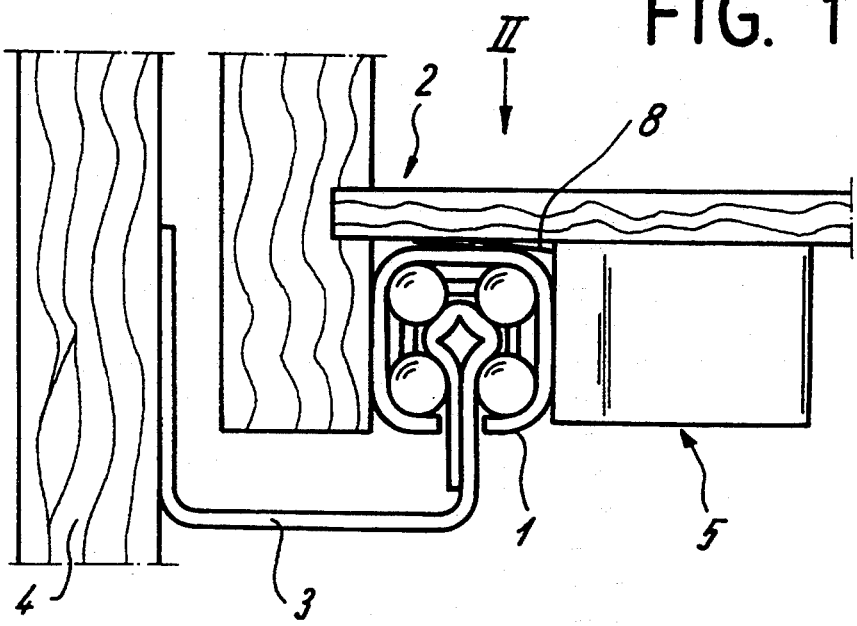
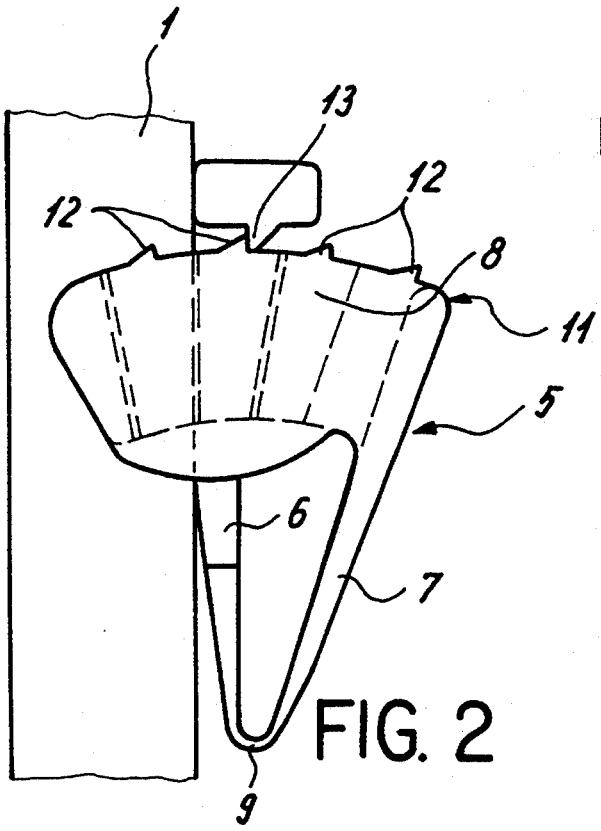
FIG. 2
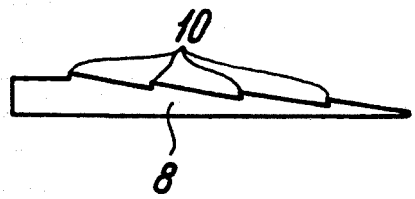
FIG. 3
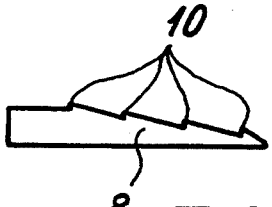
FIG. 4

ADJUSTMENT DEVICE TO ALIGN A DRAWER

FIELD OF THE INVENTION

The present invention relates generally to an adjustment device to align a drawer or other type of pull-out structure that is mounted on rails. More specifically, the present invention relates to an adjustment device having a basic body that can be fastened to the rail or to the drawer. An activation part is hinged to the basic body and has a wedge piece, which can be moved in order to achieve alignment between the rail and the drawer.

BACKGROUND OF THE INVENTION

Adjustment devices of the above type are known in a plurality of embodiments. However, the previously known adjustment devices are quite expensive to construct and/or relatively complicated to operate.

SUMMARY OF THE INVENTION

It is an object of the present invention to create an adjustment device which is characterized on the one hand by an extremely simple and uncomplicated structure, and on the other hand, by an equal simplicity of operation.

According to the present invention, this object is achieved as follows: The basic body, the activation part, and the wedge piece are integrally made of plastic, and the hinge area is formed by a material constriction in the manner of a film hinge. The hinge axis runs parallel to the fastening plane of the basic body, and the wedge piece extends approximately at right angles to the hinge axis and to the activation part.

An adjustment device of such a design in the final analysis consists of one easily fabricated, integral functional part. After this part is attached to a rail or to a drawer, it can be operated easily. To achieve alignment, it is only necessary to press on the activation part and thus press the wedge piece between the rail and the drawer. The drawer is thus aligned to the rail in accordance with the insertion depth of the wedge piece.

It is also advantageous to secure the final adjustment position, by having elevations, recesses, or roughnesses at least on one side of the wedge pieces.

An especially advantageous embodiment of the present invention has the feature that the basic body, the activation part, and the wedge piece are integrally attached to a detent device to join a rail to a drawer.

The present invention includes an integral combination of the detent device and the adjustment device, which greatly reduces both manufacturing and mounting times.

According to another embodiment of the present invention, a protective stay, which avoids unintended activation, is disposed at a predetermined distance from the activation part. The protective stay is integrally attached to the detent device. Faulty operation, and unintended canceling of an accomplished alignment, are thus practically prevented.

To prevent the adjustment device from being damaged and deformed during transport, and also to prevent permanent deformations after a maximum adjustment over an extended period of time, and to ensure a return into the initial position is easily possible even after an extended period of time. In one embodiment, mutually facing surfaces of the activation part and of the basic body have guide means which correspond to one another when the activation part is moved toward or away from the basic body in the course of an adjustment.

In another embodiment, the mutually corresponding guide means can include a web that is integrally attached to the basic body and of a guide opening situated on the activation part.

BRIEF DESCRIPTION OF THE DRAWINGS

FIG. 1 is a partial front view of a drawer mounted on a rail, with an adjustment device fastened to the rail;

FIG. 2 is a view looking in the direction of Arrow II in FIG. 1, with the drawer being omitted;

FIGS. 3 and 4 are partial sectional views of the wedge piece of the adjustment device in various planes;

DETAILED DESCRIPTION OF THE PRESENTLY PREFERRED EXEMPLARY EMBODIMENTS

Figure 5:
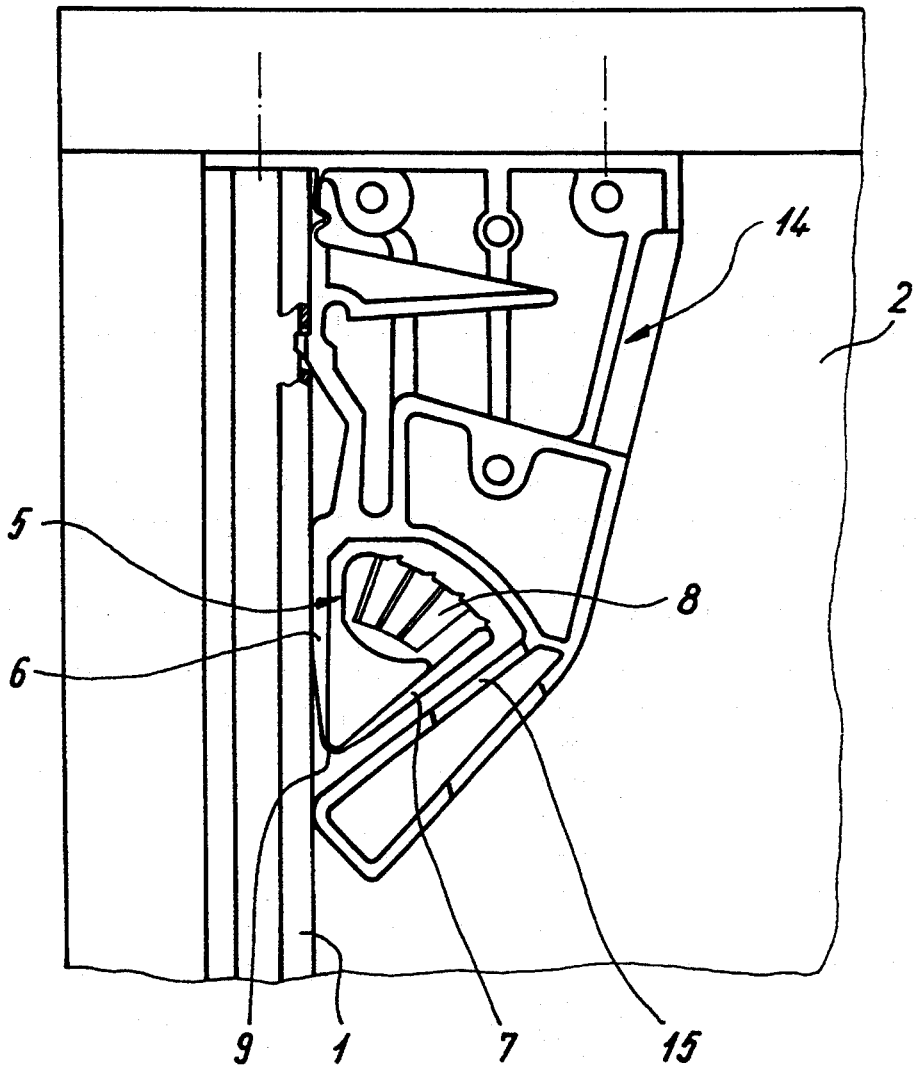
FIG. 5 is a bottom view of a drawer mounted on a rail with a detent device and an adjustment device that are fabricated as an integral unit.
Figure 6:
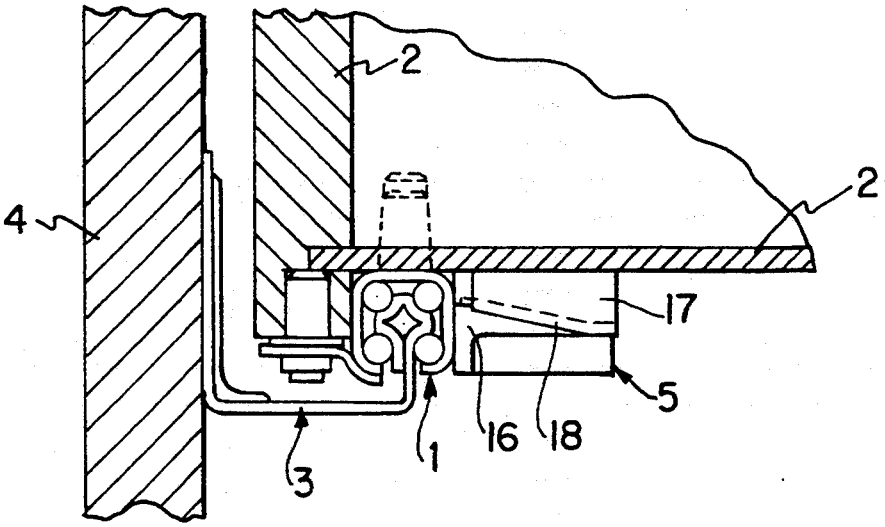
FIG. 6 is a partial front view of a drawer mounted on a rail, with an adjustment device fastened to the rail, in its transport position.
Figure 7:
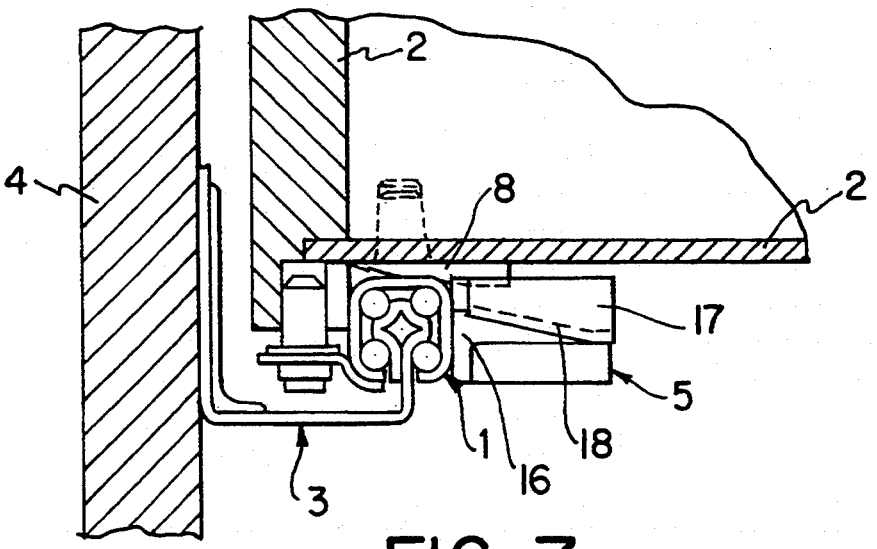
FIG. 7 is a view corresponding to FIG. 6, but with the adjustment device in its maximum detent position.

Referring to FIGS. 1 and 2, a rail 1 for supporting a drawer 2, or other type of pull-out structure is illustrated. Rail 1 moves along a fixed guide rail 3, together with the drawer 2.

The guide rail 3 is fastened in a conventional manner to a furniture body 4. An adjustment device, which in its totality is designated by arrow 5, is fastened to the rail 1. In the embodiment shown, the adjustment device 5 is used to adjust the vertical alignment of the drawer 2. Referring to FIG. 2, adjustment device 5 includes a basic body 6, an activation part 7, and a wedge part 8.

In the illustrated embodiment, the basic body 6 is fastened to the rail 1 and the activation part 7 is movably hinged to this basic body 6. The basic body 6, the activation part 7, and the wedge piece 8 are preferably integrally made of plastic as a one-piece construction. The hinge area 9 is formed by a material constriction in the manner of a film hinge. The hinge axis runs parallel to the fastening plane of the basic body 6, and the wedge piece 8 extends approximately at right angles to the hinge axis and thus also to the activation part 7.

To achieve alignment, the wedge piece 8 is pushed between the rail 1 on the one hand and the drawer 2 on the other hand, so that the drawer 2 is raised from the rail 1. In this manner, an exact height alignment of the drawer is made possible. Using this type of connection, it is extremely suitable to provide an adjustment device 5 in the area of the two lateral rails 1 of a drawer, or other type of pull-out structure.

Referring to FIGS. 3 and 4, the wedge piece 8 has saw-tooth-like elevations 10 on at least one side, so that the particular adjustment position that has been assumed can also be secured. Furthermore, the free front flank 11 of the wedge piece 8 has a plurality of detent protrusions 12, protruding therefrom. A corresponding detent cam 13 is disposed on the basic body 6. The detent protrusions 12 and the detent cams 13 mate as illustrated in FIG. 2 to additionally secure the particular adjustment position assumed by the wedge piece 8.

Referring now to FIG. 5, an embodiment of the present invention, in which the adjustment device 5 is manufactured integrally with a detent device 14 to join a rail 1 to a drawer 2, is illustrated. Otherwise, the structure of the adjustment device 5 corresponds to the structure of the previously described adjustment device 5 according to FIGS. 1 through 4.

To prevent unintentional activation of the adjustment device 5, a protective stay 15 is disposed at a predetermined distance from the activation part 7. The protective stay 15 is preferably integrally attached to the detent device 14. Depending on its installation position, the adjustment device 5 can be used for vertical or for horizontal alignment.

The adjustment device 5 according to FIGS. 6 through 13 is fastened, in a conventional manner and thus needs not be described in more detail, to a rail 1 by means of an insert piece 16 (See FIG. 12) which is integrally attached to the basic body. To align the drawer/-pull-out 2, the activation part 7 is moved and thus the wedge piece 8 that is integrally attached thereto is pressed between the rail 1 and the drawer 2. The wedge piece 8 thus lifts the drawer 2 with respect to the rail 1. The wedge piece 8 is fixed in the chosen adjustment position by the detent protrusions 10. The detent protrusions 10 themselves are conventional and need not be described in more detail. The adjustment device 5 is thus essentially comprised of a basic body 6 and the activation part 7 with its integrally attached wedge piece 8.

Figure 13:
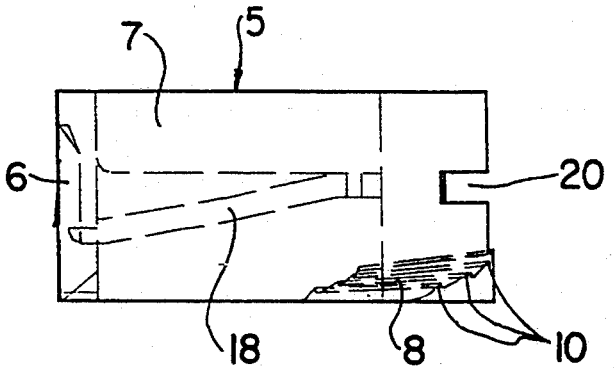
FIG. 13 is a front view of the adjustment device.

Through the hinge area 9, which is formed as a film hinge, the activation part 7 can be folded together in the direction of the Arrow A (See FIGS. 8, 9, 10 and 11) in a shear-like manner. A wall 17 is integrally attached to the basic body 6 and runs radially relative to the hinge fulcrum 9. The free end of the guide web 18 furthermore carries a detent protrusion 19 directed toward the hinge fulcrum 9. As shown in FIG. 13, the guide web 18 runs at a slant, i.e., preferably approximately parallel to the surface of wedge piece 8. The free end of the activation part 7 has a groove 20 as illustrated in FIG. 13.

Figure 8:
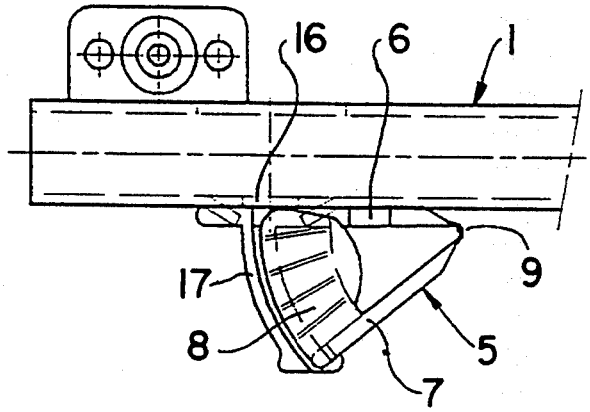
FIG. 8 is a top view of the adjustment device, fastened to the rail, in its transport position.

The operation of the adjustment device 5 will be described below with reference to the various Figures. The adjustment device 5, which is integrally made of plastic, is manufactured preferably by an injection molding tool in the form shown in FIG. 11. If the activation part 7 is then pressed in the direction of the Arrow A, toward the basic body 6, the detent protrusion 19 moves toward the groove 20, and latches behind the edge 21. The guide web 18 now lies in the groove 20, and is held and guided thereby. This results in the transport position that is illustrated in FIG. 8. If external forces act on the adjustment device 5 in this position, device 5 is not deformed or damaged, since the positive interlock between the web 18 and the groove 20 stabilize the adjustment device 5, and the wall 17 in addition functions as a protective stay.

Figure 9:
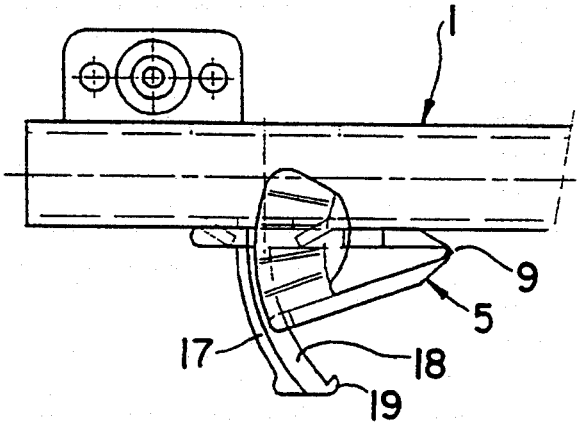
FIG. 9 is a representation corresponding to FIG. 8, with the adjustment device in its middle detent position.
Figure 10:
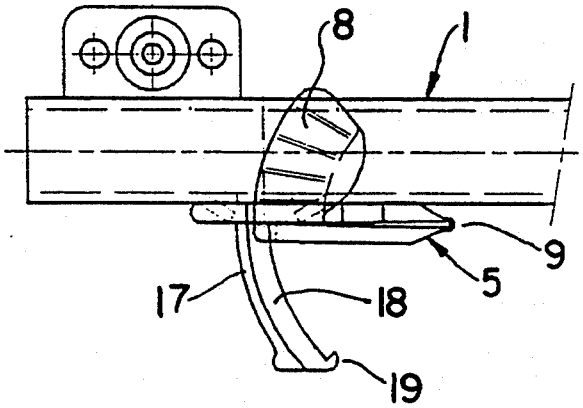
FIG. 10 is a representation corresponding to FIG. 8, with the adjustment device in its maximum position.
Figure 11:
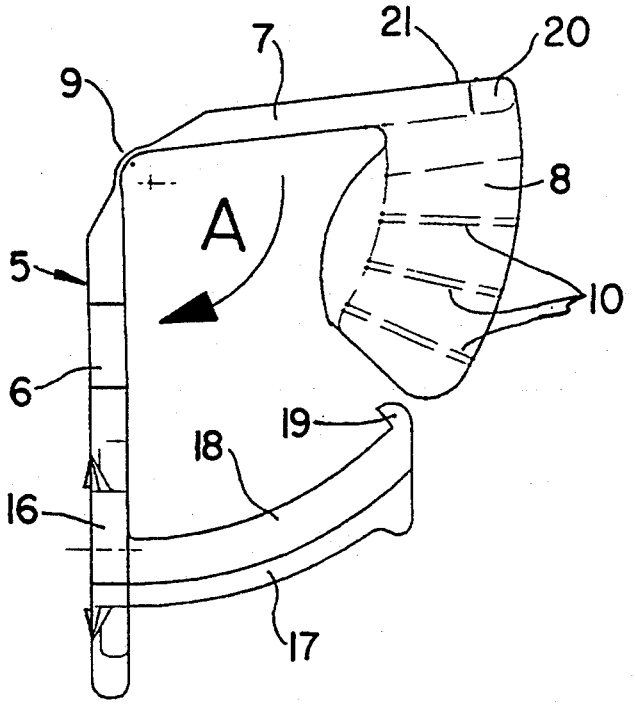
FIG. 11 is a top view of the adjustment device, with guide means which do not yet correspond with one another.
Figure 12:
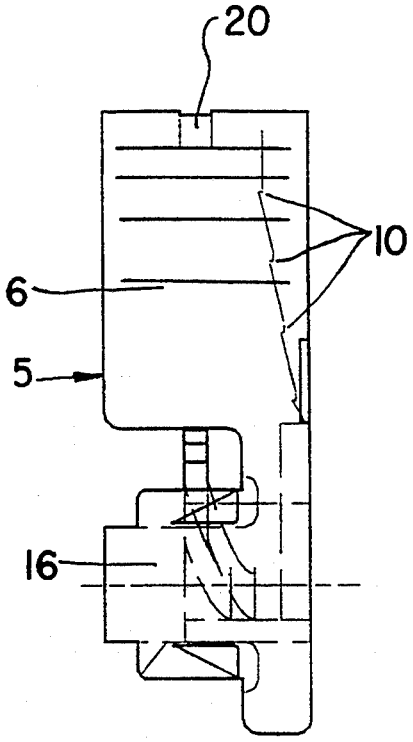
FIG. 12 is a side view of the adjustment device.

If, in the course of making an adjustment, the activation part 7 is pressed further in the direction of Arrow A, for instance into a middle detent position corresponding to FIG. 9, the groove 20 of the activation part 7 slides along the inclined web 18 in the sense of restricted guidance. If the activation part 7 is pressed still further in the direction of the Arrow A, until the activation part 7 contacts the basic body 6, the maximum adjustment position is reached, corresponding to FIGS. 10 and 7. Depending on the material, this position can lead to a relatively severe permanent deformation of the hinge area 9. If the restricted guidance through the web 18 and the groove 20 were not present, this could make it impossible to return the adjustment device 5 again to the transport or initial position corresponding to FIG. 8.

However, in the present invention, the restriction guidance through the web 18 and the groove 20 guarantees that, even if the hinge area 9 is permanently deformed, the activation part 7 can be returned to its transport position by overcoming the deformation through the restricted guidance 18,20.

The restricted guidance between the basic body 6 and the activation part 7 can also be achieved by other means than the web 18 and the groove 20, e.g., by a pin integrally attached to the basic body 6 and inclined in correspondence with the surface of the wedge piece 8, so as to engage an opening in the activation part 7. The above-described limitation of the opening path (through the detent protrusion 19 and the edge 21) could also be achieved by an enlargement at the free end of the pin. After this pin penetrates the guide openings in the activation part 7, it creates a certain detent effect—for instance according to the push-button principle—in the sense of limiting the path.

Having described the presently preferred exemplary embodiment of a new and improved adjustment device to align a drawer in accordance with the present invention, it is believed that other modifications, variations and changes will be those skilled in the art in view of the teachings set forth herein. It is, therefore, to be understood that all such variations, modification, and changes are believed to fall within the scope of the present invention as defined by the appended claims.

What is claimed is:

1. An adjustment device to align a drawer that is mounted on rails comprising:

a body member having means for being fastened to a rail, an activation part that is movably hinged to the body member at a hinge area, the activation part being connected to a wedge piece, the activation part being moveable with respect to the body member to achieve alignment between the rail and the drawer, wherein the body member, the activation part, and the wedge piece are integrally made of a plastic material, and wherein the hinge is formed by a material constriction in the form of a film hinge, and wherein the film hinge has an axis that is approximately parallel to a fastening plane disposed between the body member and the rail, and wherein the wedge piece extends approximately at right angles to the hinge axis and to the activation part.

2. The adjustment device according to claim 1, wherein the wedge piece has saw tooth elevations disposed on at least one side.

3. The adjustment device according to claim 2, wherein a mutually facing surface of the activation part and of the body member each have guide means for guiding the activation part and the body member, respectively, when the activation part is moved toward the body member to make an adjustment.

4. The adjustment device according to claim 3, wherein the guide means for the activation part includes a web that is integrally attached to the body member and the guide means for the body member includes a guide opening disposed on the activation part.

5. The adjustment device according to claim 4, wherein the web is disposed approximately parallel to the inclination of the wedge piece.

6. The adjustment device according to claim 5, wherein the web is integrally attached to a wall which extends radially relative to the hinge axis.

7. The adjustment device according claim 6, wherein a protrusion is integrally attached to a free end of the guide means for the activation part and interacts with a detent edge on the activation part so as to limit the opening path between the body member and the activation part.

8. The adjustment device according to claim 7, wherein the guide means for the body member includes a pin integrally attached to the body member and a guide opening on the activation part.

9. The adjustment device according to claim 8, wherein the pin is inclined so that it is approximately parallel to an inclination angle of the surface of the wedge piece, said surface having said saw tooth elevations.

10. The adjustment device according to claim 9, wherein free ends of the pin have a protrusion which interacts with a guide opening so as to limit the opening path between the body member and the activation part.

11. The adjustment device according claim 1, wherein the body member, the activation part, and the wedge piece are integrally attached to a detent device to join the rail to the drawer.

12. The adjustment device according to claim 11, wherein a protective stay, to prevent unintended activation of the activation part, is disposed at a predetermined distance from the activation part, said protective stay being integrally attached to the detent device.

13. The adjustment device according to claim 1, wherein the wedge piece has a free front flank that has a plurality of detent protrusions protruding therefrom, a corresponding detent cam is disposed on the basic body and mates with a detent protrusion to secure a position of the wedge piece.

* * * * *